US009350071B2

(12) United States Patent
Kobayashi et al.

(10) Patent No.: US 9,350,071 B2
(45) Date of Patent: May 24, 2016

(54) WINDOW-GLASS ANTENNA FOR VEHICLE

(75) Inventors: Hisashi Kobayashi, Matsusaka (JP); Kanya Hirabayashi, Matsusaka (JP)

(73) Assignee: Central Glass Company, Limited, Ube-shi (JP)

( * ) Notice: Subject to any disclaimer, the term of this patent is extended or adjusted under 35 U.S.C. 154(b) by 497 days.

(21) Appl. No.: 13/810,146

(22) PCT Filed: May 16, 2011

(86) PCT No.: PCT/JP2011/061151

§ 371 (c)(1),
(2), (4) Date: Jan. 14, 2013

(87) PCT Pub. No.: WO2012/008215

PCT Pub. Date: Jan. 19, 2012

(65) Prior Publication Data

US 2013/0113664 A1 May 9, 2013

(30) Foreign Application Priority Data

Jul. 15, 2010 (JP) ..... 2010-160548

(51) Int. Cl.
*H01Q 1/32* (2006.01)
*H01Q 1/12* (2006.01)

(52) U.S. Cl.
CPC ..... *H01Q 1/3291* (2013.01); *H01Q 1/1271* (2013.01)

(58) Field of Classification Search
CPC .... H01Q 1/3291; H01Q 1/1271; H01Q 13/10
USPC ..... 343/711, 712, 713, 767
See application file for complete search history.

(56) References Cited

U.S. PATENT DOCUMENTS 5,017,933 A * 5/1991 Sakurai et al. ..... 343/704
5,101,212 A * 3/1992 Shinnai et al. ..... 343/713

(Continued)

FOREIGN PATENT DOCUMENTS

JP 6-52210 U 7/1994
JP 7-170119 A 7/1995

(Continued)

OTHER PUBLICATIONS

Corresponding International Search Report with English Translation dated Aug. 16, 2011 (five (5) pages).

(Continued)

*Primary Examiner* — Dieu H Duong
(74) *Attorney, Agent, or Firm* — Crowell & Moring LLP

(57) ABSTRACT

Disclosed is a window-glass antenna for a vehicle in which a conductive film is formed on the vehicle window glass, the antenna being provided in a film-removed portion formed between an opening edge of flange and an end edge of the conductive film. The antenna includes a first feeding point provided on the film-removed portion and close to the end edge of the conductive film, a second feeding point provided on the flange and at a location near the first feeding point, and a first substantially-U-shaped element connected with the first feeding point. The first substantially-U-shaped element is provided in a manner that a conductive-film-side line is arranged adjacent to the end edge of the conductive film, a tip of the conductive-film-side line is connected with a substantially-orthogonal line, and another tip of the substantially-orthogonal line is connected with a flange-side line arranged adjacent to the flange opening edge.

13 Claims, 8 Drawing Sheets

(56) References Cited

U.S. PATENT DOCUMENTS

| | | | | |
|---|---|---|---|---|
| 5,646,637 | A | 7/1997 | Miller | |
| 5,793,333 | A * | 8/1998 | Taniguchi et al. | 343/713 |
| 5,898,407 | A | 4/1999 | Paulus et al. | |
| 7,825,865 | B2 * | 11/2010 | Ibe et al. | 343/713 |
| 2005/0140555 | A1 * | 6/2005 | Fujii et al. | 343/704 |

FOREIGN PATENT DOCUMENTS

| | | | |
|---|---|---|---|
| JP | 9-175166 | A | 7/1997 |
| JP | 2001-127520 | A | 5/2001 |
| JP | 2001-185928 | A | 7/2001 |
| JP | 2002-290145 | A | 10/2002 |
| JP | 2005-12587 | A | 1/2005 |
| JP | 2006-270602 | A | 10/2006 |
| JP | 2008-278447 | A | 11/2008 |
| JP | 2008-278481 | A | 11/2008 |

OTHER PUBLICATIONS

Japanese-language Written Opinion dated Aug. 16, 2011 (PCT/ISA/237) (four (4) pages).

* cited by examiner

WINDOW-GLASS ANTENNA FOR VEHICLE

TECHNICAL FIELD

The present invention relates to a glass antenna provided in a film-removed region of a conductive film formed on a window glass for a vehicle.

BACKGROUND OF THE INVENTION

Nowadays, an influence of infrared/ultraviolet radiation is tried to be reduced as much as possible from a viewpoint of energy saving as typified by a reduction of air-conditioning cooling load. From such a tendency, recently, a glass having a structure in which a conductive film is formed on a surface of the glass or a laminated glass having a structure in which a transparent conductive film is sandwiched between adhesive surfaces of the laminated glass comes to be adopted as a window glass for a vehicle in order to reduce a solar-radiation energy which passes into a vehicle interior.

On the other hand, recently, various systems using wireless technologies come to be mounted in the vehicle, such as an AM/FM broadcasting, a terrestrial digital broadcasting, a satellite digital radiobroadcasting, a car navigation system, a keyless entry system, a TPMS (Tire Pressure Monitoring System), an ETC (Electric Toll Collection), a cellular phone, a mobile WiMAX (Worldwide Interoperability for Microwave Access: high-speed wireless network system for mobiles), and a wireless LAN for automobile.

A transmitting-and-receiving antenna(s) for these various vehicle-mounted systems using wireless technologies is provided in the interior of automobile, in many cases. Hence, in the case that the conductive film is formed on a substantially-entire surface of the window glass as mentioned above, there is a problem that airwaves are blocked by the conductive film so that a transmitting-and-receiving performance of the transmitting-and-receiving antenna is reduced severely.

Therefore, various countermeasures are being proposed in order to enhance the transmitting-and-receiving performance in the case that the antenna is provided to the vehicle window glass to which the conductive film is provided.

For example, Japanese Patent Application Publication No. 2001-127520 proposes a method of providing an antenna line in a film-removed portion of a conductive film formed on a substantially-entire surface of a vehicle window glass. (see Patent Literature 1)

Moreover, Japanese Patent Application Publication No. 2001-185928 proposes a method of forming a slot antenna. In this technique, a part of a conductive film formed on a substantially-entire surface of vehicle window glass is cut to form a slot whose size is adjusted in conformity to a desired reception frequency, and then, power-feeding points are provided for the slot. (see Patent Literature 2)

Furthermore, Japanese Patent Application Publication No. 2002-290145 and Japanese Patent Application Publication No. 2005-12587 propose another method of forming a slot antenna. In this technique, a region in which no conductive film is formed is provided to have a certain width along an outer circumference of a vehicle window glass, and thereby, a slot is formed between an outer circumferential portion of the conductive film and a circumferential portion of a flange into which the vehicle window glass is attached. Then, power-feeding points are provided to straddle a region between the flange and the conductive film. In this method, a short-circuiting terminal for electrically short-circuiting the flange and the conductive film is provided between the flange and the conductive film, and thereby, an impedance of the slot antenna is adjusted to be matched with a characteristic impedance of a feeder cable at a desired frequency. (see Patent Literatures 3 and 4)

CITATION LIST

Patent Literature

Patent Literature 1: Japanese Patent Application Publication No. 2001-127520

Patent Literature 2: Japanese Patent Application Publication No. 2001-185928

Patent Literature 3: Japanese Patent Application Publication No. 2002-290145

Patent Literature 4: Japanese Patent Application Publication No. 2005-12587

SUMMARY OF THE INVENTION

However, in the antenna disclosed in the above Patent Literature 1, as a distance between the antenna line and an end edge of the conductive film becomes shorter, the impedance of the antenna becomes lower to disable the impedance matching with a feeder cable for the antenna so that a transceiving performance of the antenna becomes lower. This technique of the Patent Literature 1 proposes that a distance equal to $\lambda/20 \sim \lambda/5$ ($\lambda$: wavelength of airwave which should be transmitted or received) is given between the antenna line and the end edge of the conductive film in order to obtain a good transceiving performance of the antenna. Hence, the film-removed portion needs to be wide in order to obtain a good antenna performance at frequencies lower than or equal to a quasi-microwave band such as a FM band, a VHF band and a UHF band. In this case, the conductive film does not have its area necessary to sufficiently block solar-radiation energy.

Moreover, the above Patent Literature 2 shows a method of performing a masking based on a desired slot shape, for example, before performing a sputtering, as the method of forming the slot of the conductive film. The above Patent Literature 2 also shows a method of eliminating a part of the conductive film in a desired shape of the slot by laser or the like after forming the conductive film by sputtering. However, there is a problem that a man-hour is increased.

Furthermore, in the antenna as disclosed in the above Patent Literatures 3 and 4, a wavelength range of airwaves over which the airwave can be effectively transmitted or received depends on a length of the outer circumference of the vehicle window glass. Hence, it is difficult to flexibly treat various frequencies which are used by vehicle-mounted systems using wireless technologies. Moreover, the short-circuiting terminal for electrically short-circuiting the conductive film of the window glass with a vehicle body needs to be attached in addition to power-feeding terminals. Accordingly, there is a problem that the man-hour is increased when assembling the vehicle body.

It is therefore an object of the present invention to obtain a favorable transceiving performance of antenna without impairing a solar-radiation-energy-blocking performance of a conductive film provided on a surface of a vehicle window glass or provided in an adhesion plane between two glass sheets of the vehicle window glass.

According to a first aspect of the present invention, there is provided a glass antenna for a vehicle, a conductive film being formed on a surface of a window glass for the vehicle or on an adhesion plane for bonding two glass sheets constituting a laminated window glass for the vehicle, the conductive film being removed by a predetermined width along an outer circumferential portion of the window glass, the antenna comprising: a first feeding point provided on a film-removed portion of the window glass formed between an end edge of the conductive film and an opening edge of a flange for the window glass, and provided close to the opening edge of the flange or close to the end edge of the conductive film; a second feeding point provided on the conductive film or the flange which is closer to the end edge of the conductive film or the opening edge of the flange that faces through the film-removed portion to the opening edge of the flange or the end edge of the conductive film closer to the first feeding point; and a first substantially-U-shaped element formed on the film-removed portion and connected with the first feeding point, the first substantially-U-shaped element including a flange-side line located adjacent to the opening edge of the flange, a conductive-film-side line located adjacent to the end edge of the conductive film, and a substantially-orthogonal line connecting an end of the flange-side line with an end of the conductive-film-side line.

According to a second aspect of the present invention, there is provided a glass antenna for a vehicle, a conductive film being formed on a surface of a window glass for the vehicle or on an adhesion plane for bonding two glass sheets constituting a laminated window glass for the vehicle, the conductive film being removed by a predetermined width along an outer circumferential portion of the window glass, the antenna comprising: a first feeding point provided on a film-removed portion of the window glass formed between an end edge of the conductive film and an opening edge of a flange for the window glass, and provided close to the opening edge of the flange or close to the end edge of the conductive film; a second feeding point provided on a portion of the film-removed portion which is close to the end edge of the conductive film or the opening edge of the flange which faces through the film-removed portion to the opening edge of the flange or the end edge of the conductive film provided closer to the first feeding point; and a first substantially-U-shaped element formed on the film-removed portion, the first substantially-U-shaped element including a flange-side line located adjacent to the opening edge of the flange, a conductive-film-side line located adjacent to the end edge of the conductive film, and a substantially-orthogonal line connecting an end of the flange-side line with an end of the conductive-film-side line, wherein one of the flange-side line and the conductive-film-side line is connected with the first feeding point, and another of the flange-side line and the conductive-film-side line is connected with the second feeding point.

According to a third aspect of the present invention, there is provided a glass antenna for a vehicle, a conductive film being formed on a surface of a window glass for the vehicle or on an adhesion plane for bonding two glass sheets constituting a laminated window glass for the vehicle, the conductive film being removed by a predetermined width along an outer circumferential portion of the window glass, the antenna comprising: a first feeding point provided on a flange for the window glass and close to an opening edge of the flange or provided on the conductive film and close to an end edge of the conductive film; a second feeding point provided on a portion of the conductive film or a portion of the flange which is closer to the end edge of the conductive film or the opening edge of the flange which faces through a film-removed portion of the window glass to the opening edge of the flange or the end edge of the conductive film closer to the first feeding point; and a first substantially-U-shaped element formed on the film-removed portion, the first substantially-U-shaped element including a flange-side line located adjacent to the opening edge of the flange, a conductive-film-side line located adjacent to the end edge of the conductive film, and a substantially-orthogonal line connecting an end of the flange-side line with an end of the conductive-film-side line, wherein opening ends of the first substantially-U-shaped element are disposed on the film-removed portion and near the first feeding point and the second feeding point.

DETAILED DESCRIPTION OF INVENTION

Figure 1:
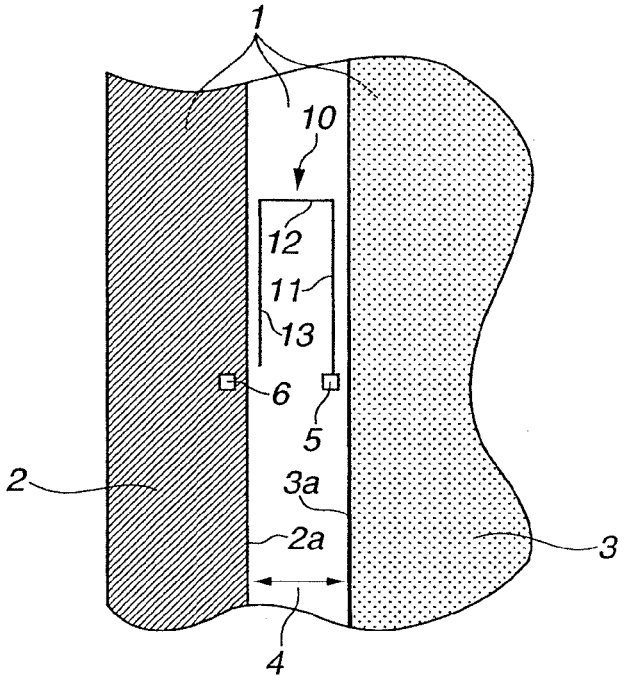
FIG. 1 An explanatory view of an antenna configuration in a first example according to the present invention.

An antenna according to an embodiment of the present invention is a glass antenna for a vehicle window glass. An electrically-conductive film (coating) is formed on a surface of the vehicle window glass, as shown in FIG. 1. By removing the electrically-conductive film by a predetermined width along an outer circumferential edge of the window glass, a film-removed portion (not-coated portion) 4 is formed between an opening edge 2*a* of a flange for the window glass and an end edge 3*a* of the electrically-conductive film 3 of the window glass (i.e. exists from the opening edge 2*a* to the end edge 3*a*). The antenna includes a first power-feeding point 5, a second power-feeding point 6 and a first substantially-U-shaped element 10. The first feeding point 5 is formed on the film-removed portion 4 and provided close to the flange opening edge 2*a* or the conductive-film end edge 3*a*. The second feeding point 6 is formed on the conductive film or the flange whichever is closer to the end edge 3*a* of the conductive film or the opening edge 2*a* of the flange that faces through the film-removed portion 4 to the flange opening edge 2*a* or the conductive-film end edge 3*a* whichever is closer to the first feeding point. That is, the film-removed portion 4 is sandwiched between the flange opening edge 2*a* located near one of the first and second feeding points and the conductive-film end edge 3*a* located near another of the first and second feeding points. The first substantially-U-shaped element 10 is formed on the film-removed portion 4 and connected with the first feeding point 5. The first substantially-U-shaped element 10 includes a flange-side line (filament) 13 arranged adjacent to the opening edge 2*a* of the flange, a conductive-film-side line (filament) 11 arranged adjacent to the end edge 3*a* of the conductive film, and a substantially-orthogonal line 12 connecting an end of the flange-side line 13 with an end of the conductive-film-side line 11.

In such an antenna, the conductive-film-side line 11 and the flange-side line 13 constituting the substantially-U-shaped element are capacitively coupled respectively with the conductive film 3 and the flange 2. Hence, the flange 2 and the conductive film 3 are coupled in high-frequencies with the substantially-orthogonal line 12 and the first feeding point. Moreover, the second feeding point is provided in a region of the flange 2. Therefore, the antenna operates as a slot antenna. Accordingly, a favorable antenna performance can be obtained even if a width of the film-removed portion 4 in which the antenna is formed is narrow.

In a case that each of a clearance amount (spacing) between the conductive-film-side line 11 and the end edge 3*a* of the conductive film 3 and a clearance amount (spacing) between the flange-side line 13 and the opening edge 2*a* of the flange 2 is smaller than or equal to 3 mm, a favorable antenna performance can be secured. As each of these clearance amounts becomes smaller, the antenna performance becomes more favorable.

In the embodiment, the first feeding point 5 is provided in proximity to the conductive-film end edge 3*a*, and the second feeding point is provided on the flange 2 (i.e., in the region of the flange 2). However, according to the present invention, the first feeding point 5 may be provided on the film-removed portion 4 (i.e., in the region of the film-removed portion 4) and in proximity to the flange opening edge 2*a*, and the second feeding point may be provided on the conductive film (i.e., in the region of the conductive film).

Moreover, the first feeding point 5 is connected with a core conductor of a coaxial cable, and the second feeding point 6 is connected with an enveloping conductor of the coaxial cable. These first feeding point 5 and second feeding point 6 are connected through the coaxial cable to a transmitting-and-receiving device. However, according to the present invention, the connection between the feeding points and the coaxial cable is not limited to this. That is, the first feeding point 5 may be connected with the enveloping conductor of the coaxial cable whereas the second feeding point 6 is connected with the core conductor of the coaxial cable. This coaxial cable may have a characteristic impedance equal to 50Ω, or have a characteristic impedance equal to 75 Ω.

Figure 2:
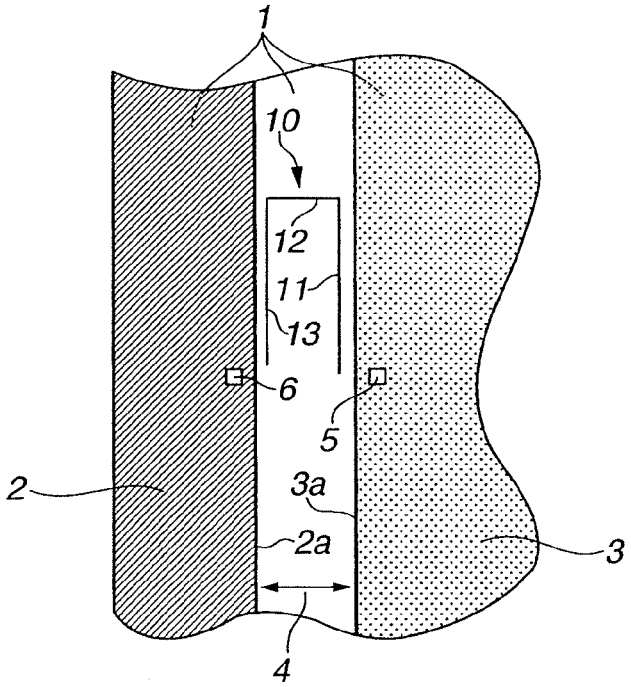
FIG. 2 An explanatory view of an antenna configuration in a second example according to the present invention.

According to the present invention, both of the first feeding point 5 and the second feeding point 6 may be provided respectively on the conductive film 3 and the flange 2 as shown in FIG. 2. Also in the antenna of this case, the conductive-film-side line 11 and the flange-side line 13 are capacitively coupled respectively with the conductive film 3 and the flange 2. Accordingly, the antenna of this case can attain the effects similar to the antenna shown in FIG. 1.

Figure 3:
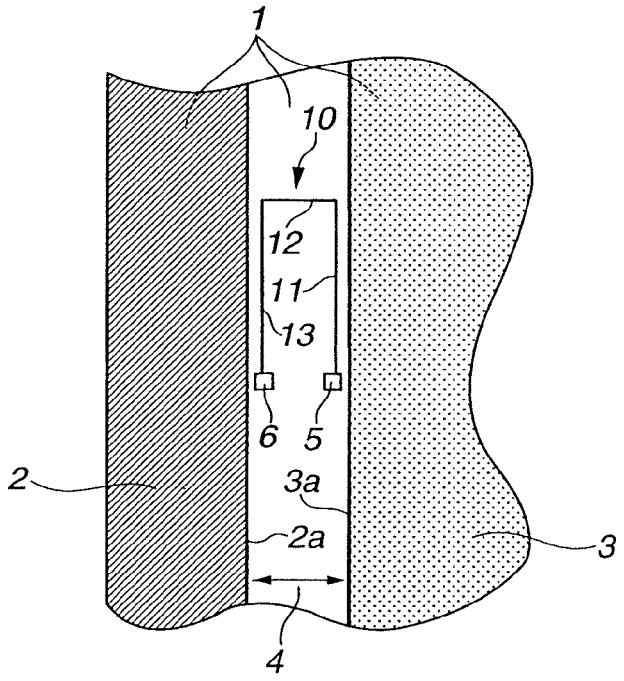
FIG. 3 An explanatory view of an antenna configuration in a third example according to the present invention.

Moreover, according to the present invention, both of the first feeding point 5 and the second feeding point 6 may be arranged on the film-removed portion as shown in FIG. 3. In this case, one end of the substantially-U-shaped element needs to be connected with the first feeding point 5, and another of the substantially-U-shaped element needs to be connected with the second feeding point 6.

This is because both the feeding points are arranged on the film-removed portion. That is, unless the feeding points are connected with the substantially-U-shaped element, these feeding points cannot be coupled in high-frequencies with the conductive film 3 and the flange 2 so that the antenna according to the present invention cannot operate as a slot antenna.

In the case that the antenna according to the present invention is constituted by one substantially-U-shaped element as shown in FIGS. 1 to 3, a favorable antenna performance can be obtained when each of lengths of the flange-side line 13 and the conductive-film-side line 11 of the substantially-U-shaped element 10 is approximately equal to $\alpha \cdot \lambda/2$ ($\alpha$: wavelength compaction ratio of glass, $\lambda$: wavelength of transceiving frequency).

Figure 4:
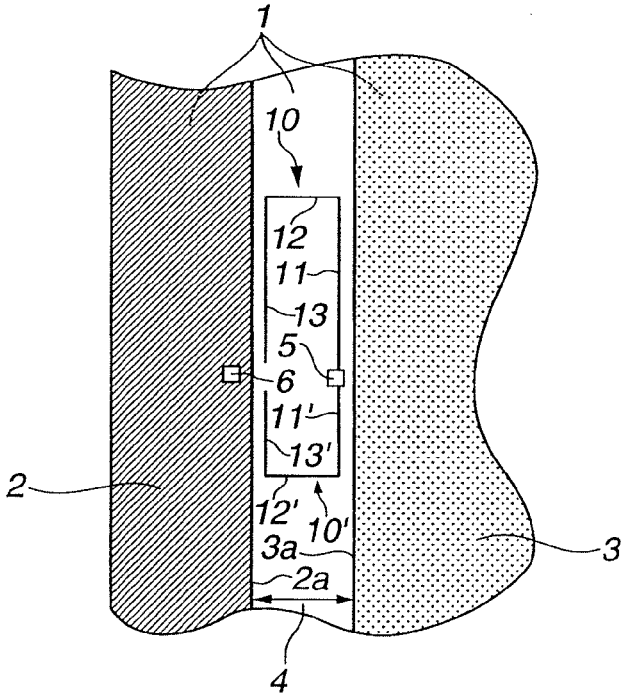
FIG. 4 An explanatory view of an antenna configuration in a fourth example according to the present invention.
Figure 5:
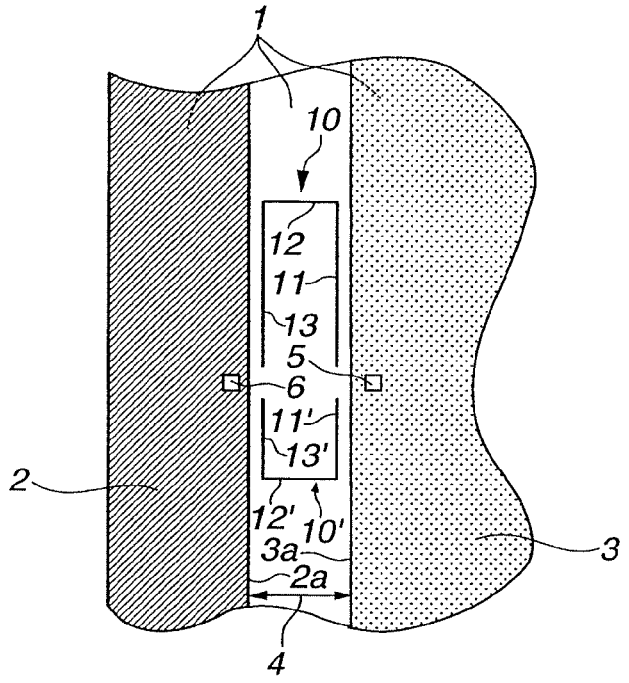
FIG. 5 An explanatory view of an antenna configuration in a fifth example according to the present invention.
Figure 6:
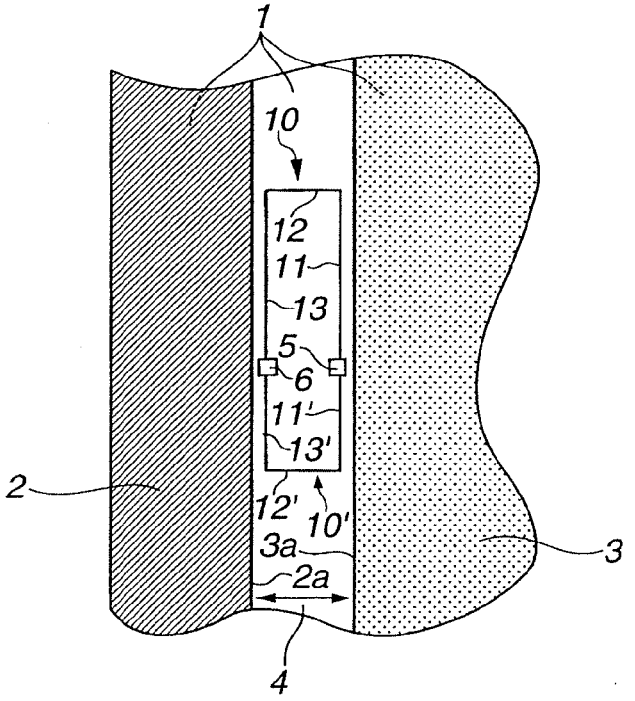
FIG. 6 An explanatory view of an antenna configuration in a sixth example according to the present invention.

Moreover, according to the present invention, a second substantially-U-shaped element 10' having the same structure as the substantially-U-shaped element 10 may be disposed in addition to the first substantially-U-shaped element 10 to face through the first feeding point 5 to each other in directions opposite to each other as shown in FIGS. 4 to 6.

The antenna of this case operates as a slot antenna because the second substantially-U-shaped element 10' has the same structure as the first substantially-U-shaped element 10.

In the case that the antenna according to the present invention is constituted by two substantially-U-shaped elements as shown in FIGS. 4 to 6, a favorable antenna performance can be obtained when a sum of the length of the conductive-film-side line 11 of the first substantially-U-shaped element 10 and a length of a conductive-film-side line 11' of the second substantially-U-shaped element 10' is approximately equal to $\alpha \cdot \lambda/2$ ($\alpha$: wavelength compaction ratio of glass, $\lambda$: wavelength of transceiving frequency) and also a sum of the length of the flange-side line 13 of the first substantially-U-shaped element 10 and a length of a flange-side line 13' of the second substantially-U-shaped element 10' is approximately equal to $\alpha \cdot \lambda/2$.

However, in this case, an impedance of the antenna needs to be matched with a characteristic impedance of feeder cable in order to obtain the favorable antenna performance. Specifically, a ratio between the length of the flange-side line 13, 13' and the length of the conductive-film-side line 11, 11' which are arranged in directions opposite to each other with respect to the first feeding point and the second feeding point is adjusted for this purpose.

Moreover, in a case that both of the first feeding point and the second feeding point provided respectively on the conductive film and the flange 2 as shown in FIG. 5, ends of the first substantially-U-shaped element may be connected respectively with ends of the second substantially-U-shaped element 10' to form a closed loop.

Figure 7:
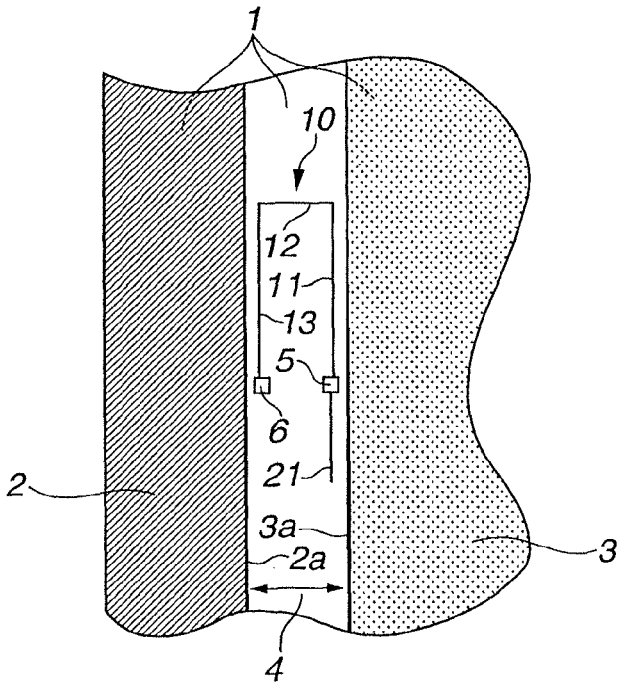
FIG. 7 An explanatory view of an antenna configuration in a seventh example according to the present invention.

Moreover, according to the present invention, at least one auxiliary line (supplemental line) may be connected with the feeding point existing on the film-removed portion 4 as shown in FIG. 7.

In this case, by connecting the auxiliary line with the feeding point, a current distribution within the antenna is changed, so that the impedance and a directivity characteristic of the antenna can be changed. That is, by adjusting a length and an extending direction of the auxiliary line, a good antenna performance can be obtained.

In the antenna of this case, the auxiliary line is provided to the first feeding point. However, according to the present invention, the auxiliary line can be connected with any feeding point formed on the film-removed portion. Hence, if necessary for adjusting the impedance and the directivity characteristic, the auxiliary line may be provided (connected) to the second feeding point. Alternatively, auxiliary lines may be provided and connected with both of the first feeding point and the second feeding point.

Figure 8:
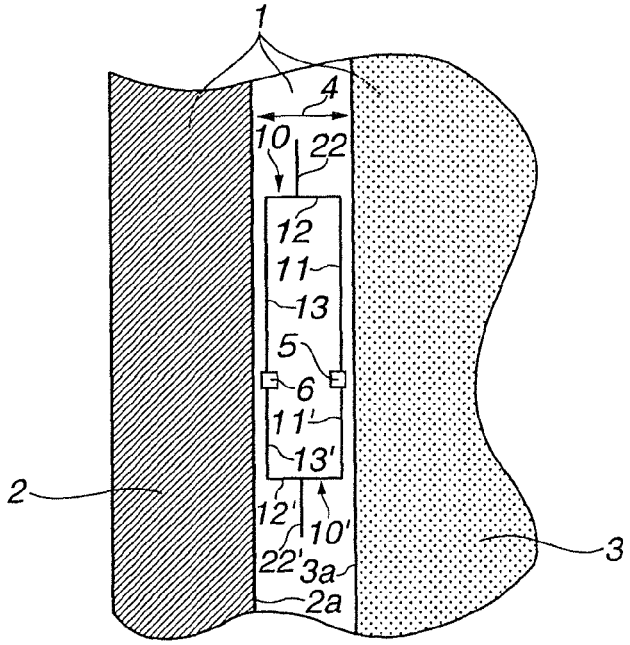
FIG. 8 An explanatory view of an antenna configuration in an eighth example according to the present invention.

Moreover, according to the present invention, an auxiliary line(s) may be connected with at least one spot of the substantially-orthogonal lines 12 and 12' as shown in FIG. 8.

In this case, by connecting the auxiliary line with the substantially-orthogonal line, the current distribution within the antenna is changed, so that the impedance and the directivity characteristic of the antenna can be changed. That is, by adjusting a length and an extending direction of the auxiliary line, a good antenna performance can be obtained.

In the antenna of this case (FIG. 8), one auxiliary line is provided to each of the substantially-orthogonal lines 12 and 12'. However, if necessary for adjusting the impedance and directivity characteristic of the antenna, two or more auxiliary lines may be provided (connected) to at least one of the substantially-orthogonal lines 12 and 12'. Alternatively, an auxiliary line(s) may be provided to only one of the substantially-orthogonal lines 12 and 12'.

Figure 9:
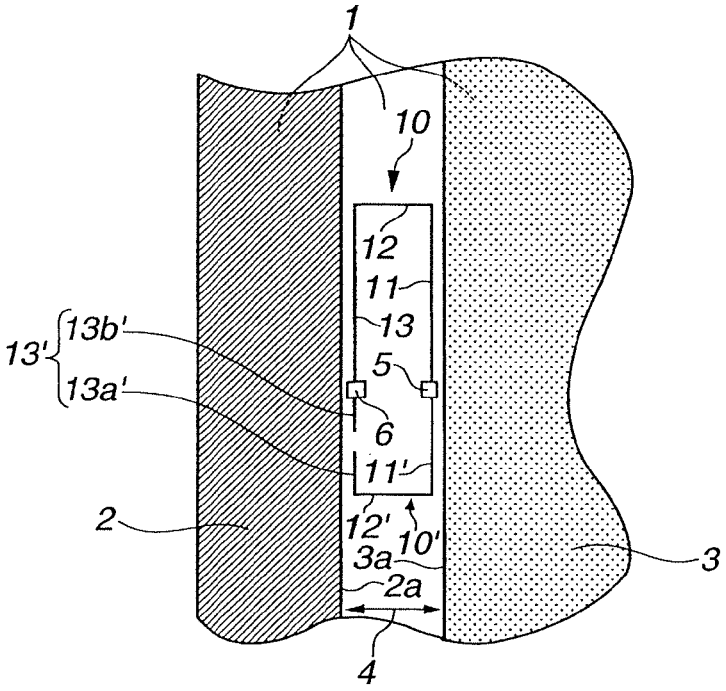
FIG. 9 An explanatory view of an antenna configuration in a ninth example according to the present invention.

Moreover, according to the present invention, a line-cutout portion may be formed at at least one spot of the flange-side line and/or the conductive-film-side line of the first substantially-U-shaped element and/or the second substantially-U-shaped element, as shown in FIG. 9

In this case, by providing the line-cutout portion in the flange-side line and/or the conductive-film-side line, a state of capacitive coupling between the flange-side lines 13, 13' or the conductive-film-side lines 11, 11' and the flange 2 or the conductive film 3 is changed, so that the impedance and the directivity characteristic of the antenna can be changed. Hence, a favorable antenna performance can be obtained.

In the antenna of this case (FIG. 9), the line-cutout portion is provided in the flange-side line 13. However, according to the present invention, the line-cutout portion may be provided at any location of the substantially-U-shaped element constituting the antenna. Moreover, the number of the line-cutout portions is not limited to one. The substantially-U-shaped element(s) may be formed with a plurality of line-cutout portions.

Figure 12:
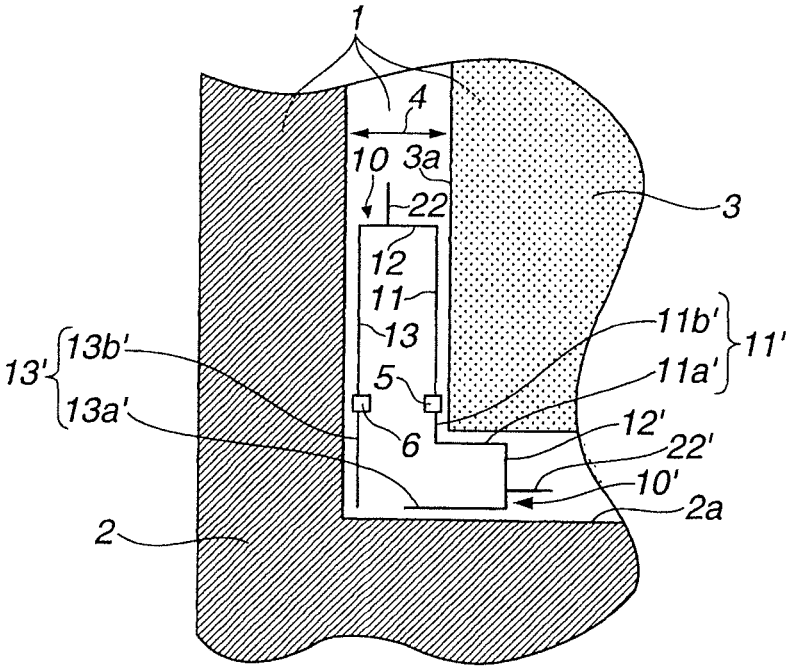
FIG. 12 An explanatory view of an antenna configuration in a twelfth example according to the present invention.

Moreover, according to the present invention, by providing both of the auxiliary line and the line-cutout portion at arbitrary spots as shown in FIG. 12, the impedance and the directivity characteristic can be adjusted.

Figure 10:
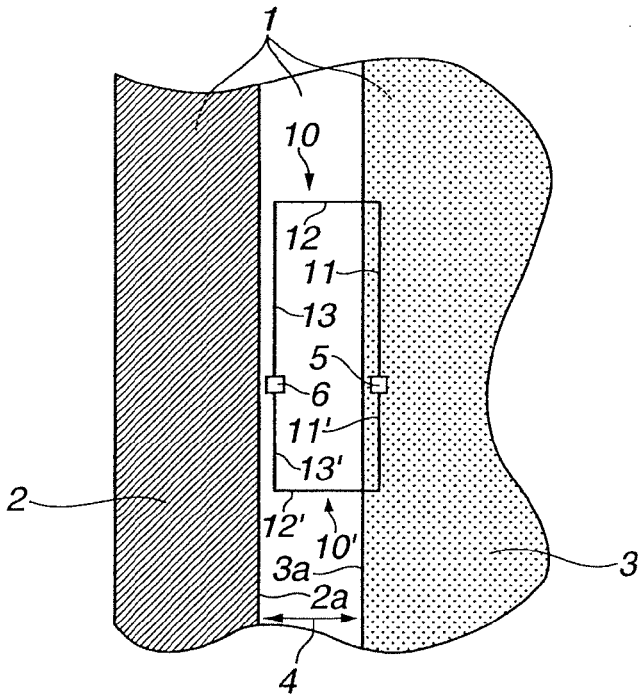
FIG. 10 An explanatory view of an antenna configuration in a tenth example according to the present invention.

Moreover, according to the present invention, in a case that the conductive film 3 is formed in an adhesion plane between two sheet glasses constituting a laminated glass, and the antenna is arranged on an outer surface of the laminated glass; a part of the antenna may overlap three-dimensionally with the conductive film as shown in FIG. 10 or may be arranged in proximity to the conductive film.

Figure 11:
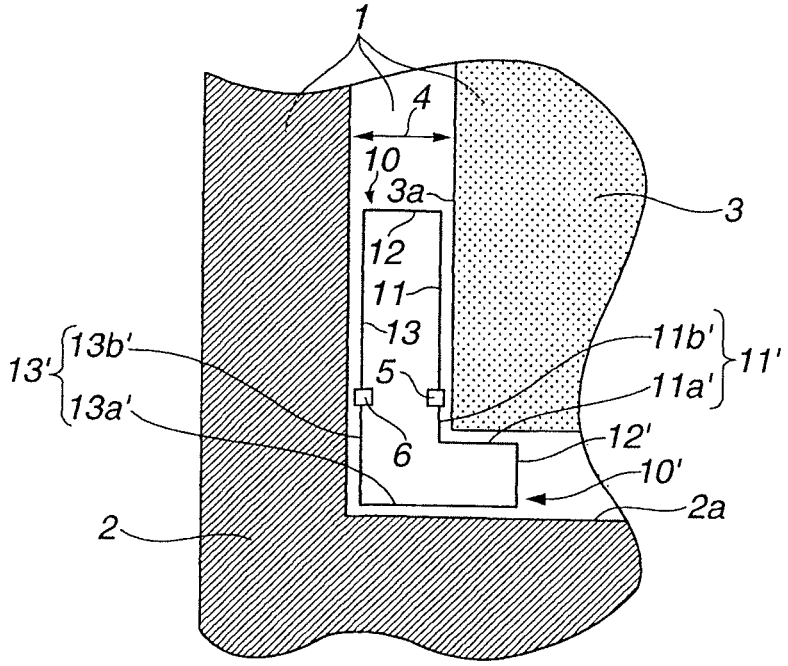
FIG. 11 An explanatory view of an antenna configuration in an eleventh example according to the present invention.

Moreover, even in a case that the film-removed portion 4 is formed in an L-shape as shown in FIG. 11 such as a corner portion of vehicle window glass, the antenna according to the present invention can attain a desired performance by bending the flange-side lines 13 and the conductive-film-side line 11 in an L-shape along the shape of the film-removed portion.

Shapes of the flange-side lines 13 and the conductive-film-side lines 11 are not limited to the above descriptions. For example, each of the shapes of the flange-side lines 13 and the conductive-film-side lines 11 can be formed in a substantially U-shape or a loop shape so as to straddle (go through) adjacent two or more corner portions of a vehicle window glass.

Moreover, although the film-removed portion 4 may be formed between the flange opening edge 2*a* and the conductive-film end edge 3*a*, the film-removed portion 4 may be formed at an arbitrary portion(s) of the conductive film 3.

Normally, the respective elements and feeding points of the antenna according to the present invention are formed by burning an electrically-conductive ceramic paste screen-printed on a glass surface. However, the respective elements and feeding points of the antenna according to the present invention may be constructed by the other member (or material) such as copper foil. Alternatively, an antenna formed of metallic thin wires may be sandwiched between glass sheets of a laminated glass.

The antenna according to the present invention is applicable not only to a window glass for a vehicle, but also applicable to an architectural window glass.

EXAMPLES

Examples according to the present invention will now be explained in detail referring to the drawings.

First Example

FIG. 1 is an explanatory view of an antenna configuration in a first example according to the present invention.

The antenna shown in FIG. 1 is a glass antenna for a window glass of a vehicle. Over whole of an interior-side surface of this window glass, the electrically-conductive film (coating) 3 is formed. The glass antenna is provided on the film-removed portion 4 of the window glass which is formed between the flange opening edge 2*a* and the end edge 3*a* of the conductive film 3. The antenna includes the first electrically-feeding point 5, the second electrically-feeding point 6 and the first substantially-U-shaped element 10. The first feeding point 5 is provided on the film-removed portion 4 (i.e., provided within a region of the film-removed portion 4) and close to the end edge 3*a* of the conductive film 3. The second feeding point 6 is provided on the flange 2 (i.e., provided within a region of the flange 2) and near the first feeding point 5. The first substantially-U-shaped element 10 is connected with the first feeding point 5. The first substantially-U-shaped element 10 is arranged in the following manner. That is, the conductive-film-side line 11 is aligned close (adjacent) to the conductive-film end edge 3*a*, and a tip of the conductive-film-side line 11 is connected with one tip of the substantially-orthogonal line 12. Another tip of the substantially-orthogonal line 12 is connected with the flange-side line 13, and the flange-side line 13 is aligned close (adjacent) to the flange opening edge 2*a*.

The first feeding point 5 is connected with a core conductor of a coaxial cable, and the second feeding point 6 is connected with an enveloping conductor of the coaxial cable. These first feeding point 5 and second feeding point 6 are connected through the coaxial cable to a transceiver (transmitting and receiving device). The coaxial cable which was used in this example has a characteristic impedance equal to 50 Ω.

As each size in the antenna shown in FIG. 1, a width of the film-removed portion 4 (i.e., a distance between the flange opening edge 2*a* and the conductive-film end edge 3*a*) is equal to 20 mm. Moreover, a length of each of the flange-side line 13 and the conductive-film-side line 11 is equal to 299 mm. Moreover, a line width of each of the conductive-film-side line 11, the substantially-orthogonal line 12 and the flange-side line 13 is equal to 1 mm. The substantially-orthogonal line 12 is perpendicular to a longitudinal direction of the film-removed portion 4. Each element (the first substantially-U-shaped element 10) is formed by burning an electrically-conductive ceramic paste on the window glass. A clearance amount (spacing) between the flange-side line 13 and the flange opening edge 2*a* is equal to 1 mm, and also, a clearance amount (spacing) between the conductive-film-side line 11 and the conductive-film end edge 3*a* is equal to 1 mm.

In the antenna shown in FIG. 1, the respective lengths of the lines 11, 12 and 13 of the element 10 were adjusted to cause a resonance substantially at 315 MHz, by regarding a wavelength compaction ratio (wavelength shortening ratio) a of the glass as being equal to 0.7. However, dimensions according to the present invention are not limited to the above-mentioned sizes.

Figure 15:
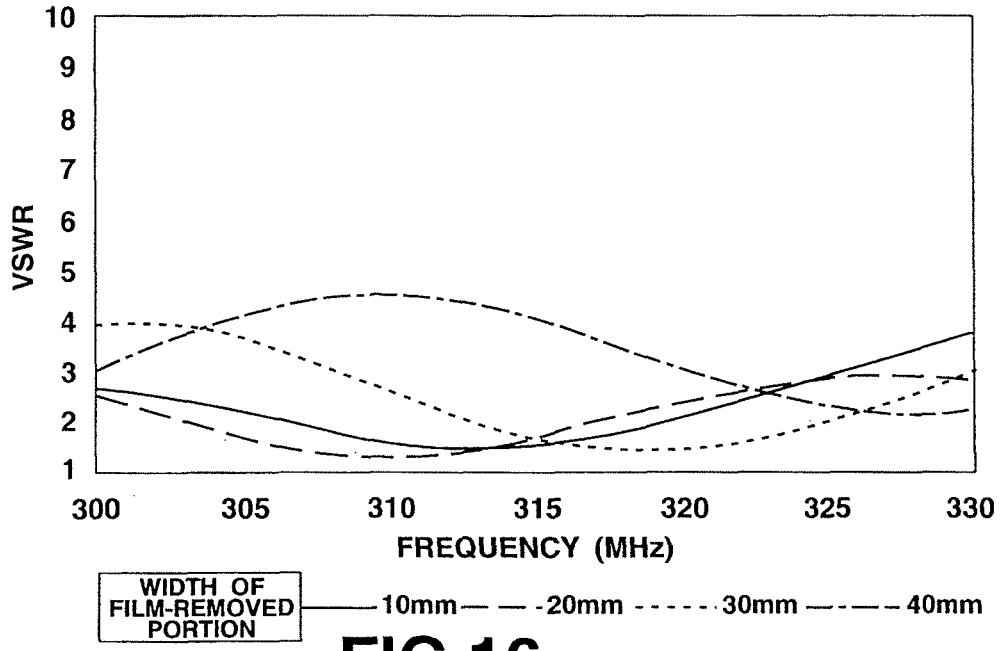
FIG. 15 A view showing a characteristic change of VSWR around 315 MHz relative to a width change of a film-removed portion, in a case of the antenna in the first example according to the present invention.
Figure 16:
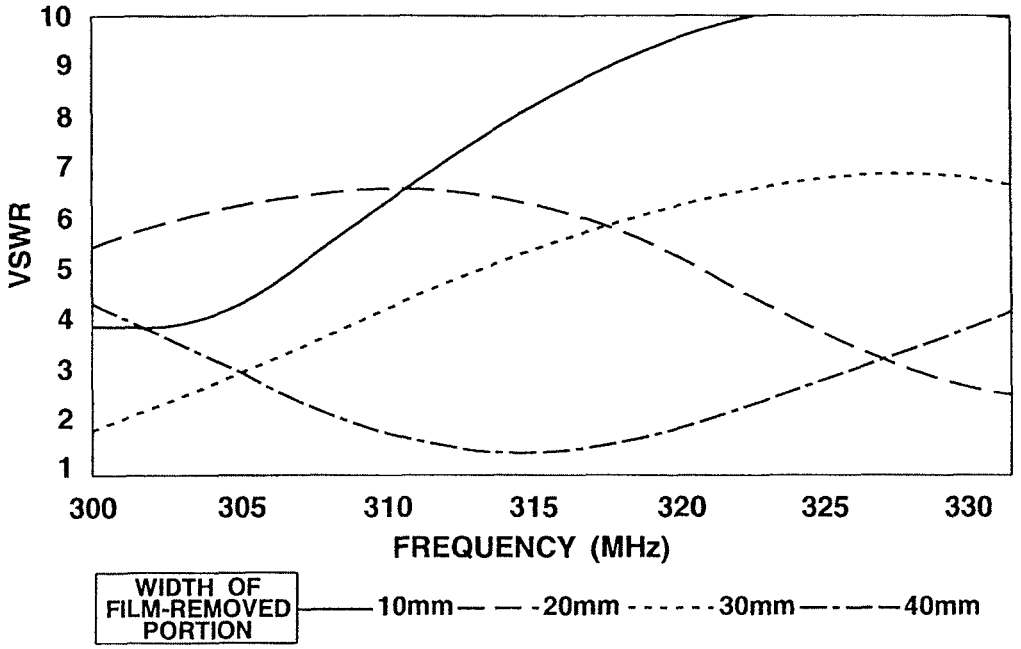
FIG. 16 A view showing a characteristic change of VSWR around 315 MHz relative to the width change of the film-removed portion, in a case of the antenna in the first comparative example.

A measurement result of VSWR (Voltage Standing Wave Ratio) in the first example according to the present invention is shown in FIG. 15. In the case of FIG. 15, the width of the film-removed portion 4 was changed from 10 mm to 40 mm. The clearance amount between the flange-side line 13 and the flange opening edge 2*a* is equal to 1 mm, and also the clearance amount between the conductive-film-side line 11 and the conductive-film end edge 3*a* is equal to 1 mm. As the result of measurement, when the width of the film-removed portion 4 is set at values smaller than or equal to 30 mm, the VSWR is smaller than or equal to 2 at 315 MHz, i.e., takes favorable values. Contrary to this, a measurement result of VSWR in a case of monopole antenna in an after-mentioned first comparative example is shown in FIG. 16 based on change of the width of the film-removed portion 4. From this measurement result, in the first comparative example, the VSWR cannot take favorable values smaller than or equal to 2 at 315 MHz unless the width of the film-removed portion 4 is designed to be larger than or equal to 40 mm.

Thus, in the antenna according to the first comparative example, the width of the film-removed portion of the conductive film which is formed on the vehicle window glass needs to be relatively large in order to obtain good values of VSWR. Hence, an area of the conductive film which is necessary to sufficiently block a solar-radiation energy cannot be secured.

Second Example

FIG. 2 is an explanatory view of an antenna configuration in a second example according to the present invention.

In the antenna according to the second example, the first feeding point 5 is disposed on the conductive film 3 (i.e., disposed within a region of the conductive film 3) and close to the conductive-film end edge 3*a*, so that the first substantially-U-shaped element 10 provided on the film-removed portion 4 (i.e., provided within the region of the film-removed portion 4) is not directly connected with the first feeding point 5. This structure is different from that of the antenna according to the first example.

A connecting relation between the coaxial cable and the first and second feeding points 5 and 6 is same as that of the first example. Therefore, explanations thereof will be omitted.

The antenna in the second example has a most suitable impedance when each of the lengths of the flange-side line 13 and the conductive-film-side line 11 of the first substantially-U-shaped element 10 is substantially equal to $\alpha\cdot\lambda/2$ ($\alpha$: wavelength compaction ratio of glass, $\lambda$: wavelength of transceiving frequency), in the same manner as the antenna of the first example. That is, in this setting, the antenna in the second example can obtain a favorable antenna performance.

Third Example

FIG. 3 is an explanatory view of an antenna configuration in a third example according to the present invention.

In the antenna according to the third example, both of the first feeding point 5 and the second feeding point 6 are disposed on the film-removed portion 4 (i.e., disposed within the region of the film-removed portion 4). Moreover, the feeding points 5 and 6 are connected respectively with the conductive-film-side line and the flange-side line 13. This structure is different from that of the antenna according to the first example.

The connecting relation between the coaxial cable and the first and second feeding points 5 and 6 is same as that of the first and second examples. Therefore, explanations thereof will be omitted.

The antenna in the third example has a most suitable impedance when each of the lengths of the flange-side line 13 and the conductive-film-side line 11 of the first substantially-U-shaped element 10 is substantially equal to $\alpha\cdot\lambda/2$ ($\alpha$: wavelength compaction ratio of glass, $\lambda$: wavelength of transceiving frequency), in the same manner as the antenna of the first or second example. That is, in this setting, the antenna in the third example can obtain a good antenna performance.

Fourth Example

FIG. 4 is an explanatory view of an antenna configuration in a fourth example according to the present invention.

In the antenna according to the fourth example, a second substantially-U-shaped element 10' having the same configuration as the first substantially-U-shaped element 10 of the first example is added to the first substantially-U-shaped element 10 of the first example. The second substantially-U-shaped element 10' is connected with the first feeding point 5 from a direction opposite to that of the first substantially-U-shaped element 10 which is located opposite to the second substantially-U-shaped element 10' with respect to the first feeding point 5. This structure is different from that of the antenna according to the first example.

The antenna in the fourth example can obtain a favorable antenna performance, when the sum of lengths of a conductive-film-side line 11' constituting the second substantially-U-shaped element 10' and the conductive-film-side line 11 constituting the first substantially-U-shaped element 10 is substantially equal to $\alpha\cdot\lambda/2$ ($\alpha$: wavelength compaction ratio of glass, $\lambda$: wavelength of transceiving frequency) and also when the sum of lengths of a flange-side line 13' constituting the second substantially-U-shaped element 10' and the flange-side line 13 constituting the first substantially-U-shaped element 10 is substantially equal to $\alpha\cdot\lambda/2$.

Moreover, an impedance of the antenna in the fourth example can be adjusted by adjusting the lengths of the flange-side lines 13 and 13' which are aligned in directions opposite to each other with respect to the second feeding point 6 and the lengths of the conductive-film-side lines 11 and 11' which are aligned in directions opposite to each other with respect to the first feeding point 5. Thereby, a favorable performance of the antenna can be attained.

Fifth Example

FIG. 5 is an explanatory view of an antenna configuration in a fifth example according to the present invention.

According to the fifth example, a second substantially-U-shaped element 10' having the same configuration as the first substantially-U-shaped element 10 of the second example is added to the first substantially-U-shaped element 10 of the second example. The second substantially-U-shaped element 10' is arranged opposite to the first substantially-U-shaped element 10 with respect to the first feeding point 5 (i.e., to sandwich the first feeding point 5 therebetween). This structure is different from the antenna according to the second example.

Since a condition for the attainment of favorable antenna performance in the fifth example is same as that of the fourth example, explanations thereof will be omitted.

Sixth Example

FIG. 6 is an explanatory view of an antenna configuration in a sixth example according to the present invention.

According to the sixth example, a second substantially-U-shaped element 10' having the same configuration as the first substantially-U-shaped element 10 of the third example is added to the first substantially-U-shaped element 10 of the third example. The second substantially-U-shaped element 10' is connected to the first feeding point 5 and the second feeding point 6 from a direction opposite to that of the first substantially-U-shaped element 10 which is located opposite to the second substantially-U-shaped element 10' with respect to the feeding points 5 and 6. This structure is different from the antenna of the third example.

Since an antenna operation and a condition for the attainment of favorable antenna performance in the sixth example are same as those of the fourth and fifth examples, explanations thereof will be omitted.

Seventh Example

FIG. 7 is an explanatory view of an antenna configuration in a seventh example according to the present invention.

In the antenna according to the seventh example, an auxiliary line (supplemental line) 21 is connected with the first feeding point 5. This structure is different from the antenna of the third example.

According to the seventh example, a current distribution which is induced in the antenna can be varied by providing the auxiliary line 21 to the first feeding point. In detail, the impedance and/or a directivity characteristic of the antenna can be adjusted to attain its favorable state, by adjusting a length of the auxiliary line 21, a direction in which the auxiliary line 21 is connected with the first feeding point and a presence/absence of bending of the auxiliary line 21.

Eighth Example

FIG. 8 is an explanatory view of an antenna configuration in an eighth example according to the present invention.

According to the eighth example, an auxiliary line 22 is connected with the substantially-orthogonal line 12 of the first substantially-U-shaped element 10 of the sixth example, and also, an auxiliary line 22' is connected with a substantially-orthogonal line 12' of the second substantially-U-shaped element 10' of the sixth example. This structure is different from the antenna of the sixth example.

Functions of the auxiliary lines 22 and 22' of the eighth example are similar to the function of the auxiliary line 21 connected with the first feeding point in the antenna of the seventh example. Hence, explanations thereof will be omitted.

Ninth Example

FIG. 9 is an explanatory view of an antenna configuration in a ninth example according to the present invention.

In the antenna according to the ninth example, the flange-side line 13' of the second substantially-U-shaped element 10' of the sixth example is divided (cut) into a flange-side line 13*a*' and a flange-side line 13*b*' so that a line-cutout portion (line-removed portion) is provided to the flange-side line 13' between the flange-side line 13*a*' and the flange-side line 13*b*'. This structure is different from the antenna of the sixth example.

According to the ninth example, a state of capacitive coupling between the flange-side lines 13, 13' and the conductive-film-side lines 11, 11' and the flange 2 and the conductive film 3 is changed by forming the line-cutout portion. Thereby, the impedance and the directivity characteristic of the antenna can be changed.

Tenth Example

FIG. 10 is an explanatory view of an antenna configuration in a tenth example according to the present invention.

The antenna according to the tenth example is formed on an outer surface of a laminated glass. The conductive film 3 is provided between adhesion surfaces of two sheet glasses constituting the laminated glass. The conductive-film-side lines 11 and 11' of the antenna overlap three-dimensionally with the conductive film 3 in the laminated glass. Such a structure is different from the antenna of the sixth example.

Eleventh Example

FIG. 11 is an explanatory view of an antenna configuration in an eleventh example according to the present invention.

According to the eleventh example, the antenna of the sixth example is bent to fit (meet) an L-shaped portion of the film-removed portion 4. Such a bent antenna is arranged in the L-shape of the film-removed portion 4. This structure is different from the antenna of the sixth example.

In the antenna according to the eleventh example, the flange-side line 13' and the conductive-film-side line 11' which constitute the second substantially-U-shaped element 10' are arranged to fit the shape of the film-removed portion 4. Hence, these flange-side line 13' and conductive-film-side line 11' are capacitively coupled with the flange 2 and the conductive film 3 in the same manner as the sixth example. Therefore, the impedance of the antenna is not worsened.

In this regard, since the antenna is bent to meet the shape of the film-removed portion, a directivity characteristic of the antenna is different from that of the sixth example.

Twelfth Example

FIG. 12 is an explanatory view of an antenna configuration in a twelfth example according to the present invention.

According to the twelfth example, an auxiliary line 22 is provided (connected) to the substantially-orthogonal line 12 of the first substantially-U-shaped element 10 of the eleventh example, and also, an auxiliary line 22' is provided to the substantially-orthogonal line 12' of the second substantially-U-shaped element 10' of the eleventh example. Moreover, a line-cutout portion is formed at an intermediate portion of the flange-side line 13' of the eleventh example. This structure is different from the antenna of the eleventh example.

By providing the auxiliary line and the line-cutout portion in combination as the antenna of the twelfth example, the current distribution which occurs on the antenna can be adjusted, so that the impedance and directivity characteristic of the antenna can be adjusted optimally.

Thirteenth Example

Figure 13:
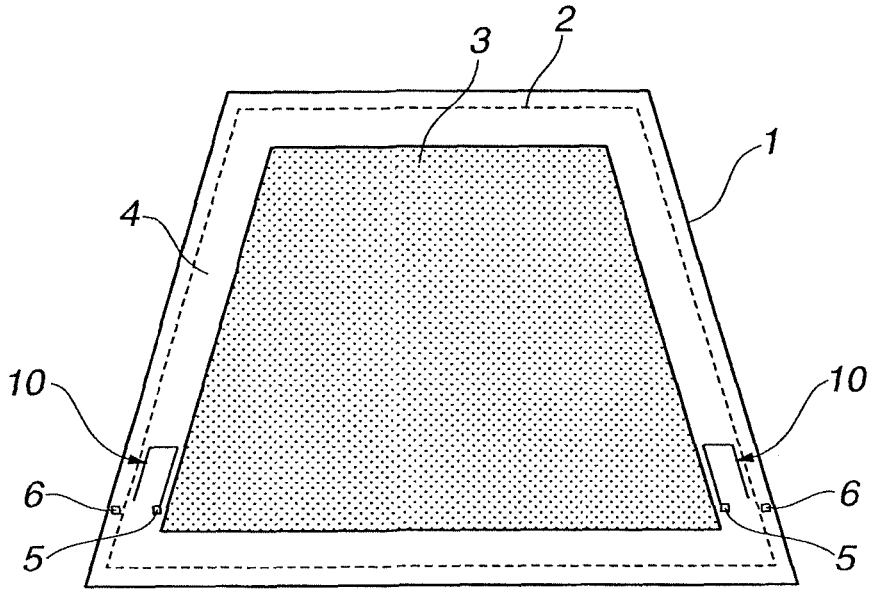
FIG. 13 A front overall view in a case that an antenna pattern of the first example according to the present invention is provided on a front window.

FIG. 13 is a view showing a thirteenth example according to the present invention. In this example, two antennas constructed as shown in the first example are provided on a front window of the vehicle.

The antennas provided to the front window can be used for a diversity reception by optimizing both the antennas for an identical frequency. Alternatively, the two antennas provided to the front window can be used respectively for different purposes by optimizing the two antennas respectively for two different frequencies.

Although the invention has been described above with reference to the certain preferable examples (embodiments), the invention is not limited to these examples. Various variations will be possible according to the present invention.

First Comparative Example

Figure 14:
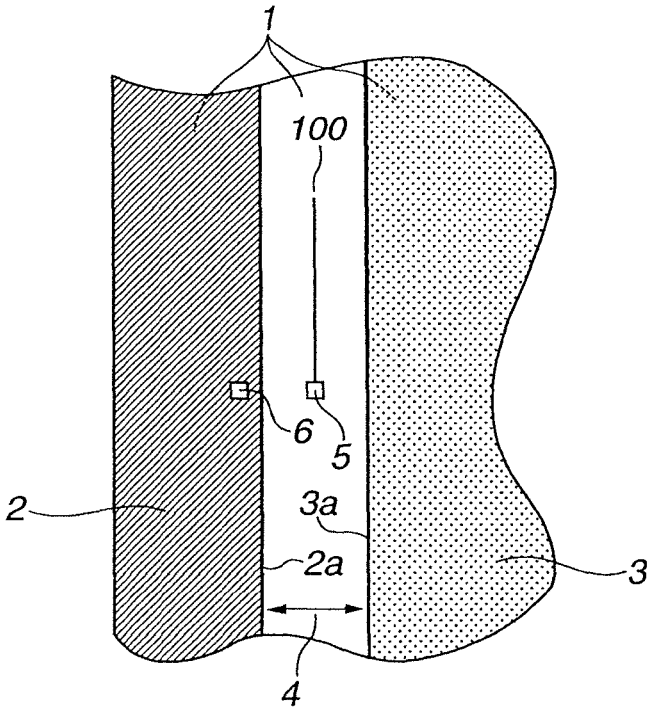
FIG. 14 An explanatory view of an antenna configuration in a first comparative example.

According to an antenna shown in FIG. 14, the first feeding point 5 is disposed on an imaginary center line of the film-removed portion 4, and a monopole element 100 is connected with the first feeding point 5. In the same manner as the first example, the first feeding point 5 is connected with a core conductor of a coaxial cable having a characteristic impedance equal to 50Ω whereas the second feeding point 6 is connected with an enveloping conductor of the coaxial cable.

When a length of the monopole element 100 was set at 199 mm which is approximately equal to "$\alpha \cdot \lambda/4$" under a condition of 315 MHz, a relation between the width of the film-removed portion 4 and the VSWR at 315 MHz was obtained as shown in FIG. 16. At 315 MHz, the VSWR does not take any good value which is smaller than or equal to 2, unless the width of the film-removed portion 4 is broadened to be greater than or equal to 40 mm. Accordingly, it is found that an impedance matching between the antenna and the coaxial cable is not attained.

This is because the monopole element 100 is capacitively coupled with the flange 2 and the conductive film 3, and thereby, a part of electric current induced on the monopole element flows into the flange 2 and the conductive film 3. Thus, the impedance of the antenna is lowered.

Configurations According to the Present Invention

Some configurations obtainable from the above embodiments and examples will be listed below.

(1) A glass antenna for a vehicle, a conductive film being formed on a surface of a window glass for the vehicle or on an adhesion plane for bonding two glass sheets constituting a laminated window glass for the vehicle, the conductive film being removed by a predetermined width along an outer circumferential portion of the window glass, the antenna comprising: a first feeding point provided on a film-removed portion of the window glass formed between an end edge of the conductive film and an opening edge of a flange for the window glass, and provided close to the opening edge of the flange or close to the end edge of the conductive film; a second feeding point provided on the conductive film or the flange that faces through the film-removed portion to the opening edge of the flange or the end edge of the conductive film whichever is closer to the first feeding point; and a first substantially-U-shaped element formed on the film-removed portion and connected with the first feeding point, the first substantially-U-shaped element including a flange-side line located adjacent to the opening edge of the flange, a conductive-film-side line located adjacent to the end edge of the conductive film, and a substantially-orthogonal line connecting an end of the flange-side line with an end of the conductive-film-side line.

(2) The glass antenna as described in the above item (1), wherein the antenna further comprises a second substantially-U-shaped element having the same structure as the first substantially-U-shaped element, and the first substantially-U-shaped element and the second substantially-U-shaped element are connected with the first feeding point from directions opposite to each other with respect to the first feeding point.

(3) The glass antenna as described in one of the above items (1) and (2), wherein the first feeding point is further connected with an auxiliary line.

(4) A glass antenna for a vehicle, a conductive film being formed on a surface of a window glass for the vehicle or on an adhesion plane for bonding two glass sheets constituting a laminated window glass for the vehicle, the conductive film being removed by a predetermined width along an outer circumferential portion of the window glass, the antenna comprising: a first feeding point provided on a film-removed portion of the window glass formed between an end edge of the conductive film and an opening edge of a flange for the window glass, and provided close to the opening edge of the flange or close to the end edge of the conductive film; a second feeding point provided on a portion of the film-removed portion which is close to the end edge of the conductive film or the opening edge of the flange that faces through the film-removed portion to the opening edge of the flange or the end edge of the conductive film whichever is closer to the first feeding point; and a first substantially-U-shaped element formed on the film-removed portion, the first substantially-U-shaped element including a flange-side line located adjacent to the opening edge of the flange, a conductive-film-side line located adjacent to the end edge of the conductive film, and a substantially-orthogonal line connecting an end of the flange-side line with an end of the conductive-film-side line, wherein one of the flange-side line and the conductive-film-side line is connected with the first feeding point, and another of the flange-side line and the conductive-film-side line is connected with the second feeding point.

(5) The glass antenna as described in the above item (4), wherein the antenna further comprises a second substantially-U-shaped element having the same structure as the first substantially-U-shaped element, and the first substantially-U-shaped element and the second substantially-U-shaped element are connected with the first feeding point and connected with the second feeding point, from directions opposite to each other with respect to the first feeding point and the second feeding point.

(6) The glass antenna as described in one of the above items (4) and (5), wherein at least one of the first feeding point and the second feeding point is further connected with an auxiliary line.

(7) A glass antenna for a vehicle, a conductive film being formed on a surface of a window glass for the vehicle or on an adhesion plane for bonding two glass sheets constituting a laminated window glass for the vehicle, the conductive film being removed by a predetermined width along an outer circumferential portion of the window glass, the antenna comprising: a first feeding point provided on a flange for the window glass and close to an opening edge of the flange or provided on the conductive film and close to an end edge of the conductive film; a second feeding point provided on the conductive film or the flange that faces through a film-removed portion of the window glass to the opening edge of the flange or the end edge of the conductive film whichever is closer to the first feeding point; and a first substantially-U-shaped element formed on the film-removed portion, the first substantially-U-shaped element including a flange-side line located adjacent to the opening edge of the flange, a conductive-film-side line located adjacent to the end edge of the conductive film, and a substantially-orthogonal line connecting an end of the flange-side line with an end of the conductive-film-side line, wherein opening ends of the first substantially-U-shaped element are disposed on the film-removed portion and near the first feeding point and the second feeding point.

(8) The glass antenna as described in the above item (7), wherein the antenna further comprises a second substantially-U-shaped element having the same structure as the first substantially-U-shaped element, and the first substantially-U-shaped element and the second substantially-U-shaped element are arranged to face through the first feeding point and the second feeding point to each other in directions opposite to each other.

(9) The glass antenna as described in one of the above items (1), (3), (4), (6) and (7), wherein a length of each of the flange-side line and the conductive-film-side line of the first substantially-U-shaped element is substantially equal to $\alpha\cdot\lambda/2$, where $\alpha$ denotes a wavelength compaction ratio of the glass, and $\lambda$ denotes a wavelength of transceiving frequency.

(10) The glass antenna as described in one of the above items (2), (5) and (8), wherein a sum of a length of the flange-side line of the first substantially-U-shaped element and a length of a flange-side line of the second substantially-U-shaped element is substantially equal to $\alpha\cdot\lambda/2$, where $\alpha$ denotes a wavelength compaction ratio of the glass, and $\lambda$ denotes a wavelength of transceiving frequency, and a sum of a length of the conductive-film-side line of the first substantially-U-shaped element and a length of a conductive-film-side line of the second substantially-U-shaped element is substantially equal to $\alpha\cdot\lambda/2$.

(11) The glass antenna as described in one of the above items (1) to (10), wherein an auxiliary line is provided to at least one of the substantially-orthogonal line of the first substantially-U-shaped element and a substantially-orthogonal line of the second substantially-U-shaped element.

(12) The glass antenna as described in one of the above items (1) to (11), wherein at least one of the flange-side line and the conductive-film-side line of the substantially-U-shaped element is formed with a line-cutout portion.

(13) The glass antenna as described in one of the above items (1) to (12), wherein a width of the film-removed portion is smaller than or equal to 30 mm.

(14) The glass antenna as described in one of the above items (1) to (13), wherein each of shapes of the flange-side line and the conductive-film-side line constituting the substantially-U-shaped element is at least one of a substantially straight-line shape, a substantially L shape, a substantially U shape, a loop shape and a circular-arc shape.

(15) The glass antenna as described in one of the above items (1) to (14), wherein a part of the antenna formed on a surface of the laminated window glass overlaps three-dimensionally with the conductive film formed on the adhesion plane of the laminated window glass, to enable a capacitive coupling therebetween.

(16) The glass antenna as described in one of the above items (1) to (15), wherein the conductive film is formed on a substantially entire range of the surface or the adhesion plane of the window glass.

(17) The glass antenna as described in one of the above items (1) to (16), wherein the window glass or the laminated window glass is a front window glass, a rear window glass, a side window glass or a sunroof glass of the vehicle.

(18) A glass antenna system for a vehicle, comprising two or more glass antennas as described in at least one of the above items (1) to (17), wherein the two or more glass antennas are provided at two or more spots of at least one of window glasses for the vehicle or laminated window glasses for the vehicle.

Advantageous Effects

According to the present invention, the antenna functions as a slot antenna by providing the antenna in the film-removed portion given along an outer circumferential portion of the conductive film formed on the vehicle window glass. Hence, the width of the film-removed portion can be designed to be narrow. Therefore, a good transmitting-and-receiving performance of the antenna can be obtained without impairing a performance of the conductive film which blocks energy of solar radiation.

Moreover, according to the present invention, the conductive lines constituting the antenna are capacitively coupled with the flange and the conductive film so that the antenna functions as a slot antenna. Hence, the conductive film do not necessarily need to be arranged in the same plane as the antenna. For example, even in the case that the conductive film is arranged between adhesion surfaces of (i.e., arranged in an adhesion plane between) two sheet glasses constituting a laminated glass, a favorable transceiving performance can be obtained.

Furthermore, even if the film-removed portion has any length, the antenna according to the present invention can attain a good performance at a desired frequency(frequencies) by adjusting the lengths of the conductive lines aligned adjacent to the flange opening edge and the conductive-film end edge. For example, generally, in a case that the conductive film is provided in an adhesion plane between two sheet glasses of the laminated glass, a region in which the conductive film is not formed needs to be given along an outer circumferential portion of the laminated glass in order to cause the two sheet glasses to sufficiently adhere to each other. In this case, a film-removed portion corresponding to the above region exists between the conductive-film end edge and the flange opening edge. In this case, even if the antenna according to the present invention is formed in such a film-removed portion, a good transceiving performance can be obtained at various frequency bands higher than or equal to FM (Frequency-Modulation) band. Moreover, in this film-removed portion, a plurality of antennas can be provided.

EXPLANATION OF REFERENCE SIGNS

1 Window glass
2 Flange
2*a* Flange opening edge
3 Conductive film
3*a* Conductive-film end edge
4 Film-removed portion
5 First feeding point
6 Second feeding point
10 First substantially-U-shaped element

10' Second substantially-U-shaped element
11, 11' Conductive-film-side line
11*a*', 11*b*' Conductive-film-side line
12, 12' Substantially-orthogonal line
13, 13' Flange-side line
13*a*', 13*b*' Flange-side line
20 Auxiliary element
21 First auxiliary line
22, 22' Second auxiliary line
100 Monopole element

The invention claimed is:

1. A glass antenna for a vehicle, a conductive film being formed on a surface of a window glass for the vehicle or on an adhesion plane of a laminated window glass for the vehicle so as to block a solar-radiation energy, the conductive film being removed by a predetermined width along an outer circumferential portion of the window glass, the antenna comprising:

a first feeding point provided on a film-removed portion of the window glass formed between an end edge of the conductive film and an opening edge of a flange for the window glass, and provided close to the opening edge of the flange or close to the end edge of the conductive film;

a second feeding point provided on the conductive film or the flange that faces through the film-removed portion to the opening edge of the flange or the end edge of the conductive film whichever is closer to the first feeding point; and a first substantially-U-shaped element formed on the film-removed portion and connected with the first feeding point, the first substantially-U-shaped element including a flange-side line located adjacent to the opening edge of the flange and configured to capacitively coupled with the flange, a conductive-film-side line located adjacent to the end edge of the conductive film and configured to capacitively coupled with the conductive film, and a substantially-orthogonal line connecting an end of the flange-side line with an end of the conductive-film-side line and configured to function as a slot antenna, wherein a core conductor of a coaxial cable is connected with the first feeding point or the second feeding point whereas an enveloping conductor of the coaxial cable is connected with the second feeding point or the first feeding point such that the first feeding point and the second feeding point are connected through the coaxial cable to a transceiver.

2. The glass antenna according to claim 1, wherein the antenna further comprises a second substantially-U-shaped element having the same structure as the first substantially-U-shaped element, and the first substantially-U-shaped element and the second substantially-U-shaped element are connected with the first feeding point from directions opposite to each other with respect to the first feeding point.

3. The glass antenna according to claim 2, wherein a sum of a length of the flange-side line of the first substantially-U-shaped element and a length of a flange-side line of the second substantially-U-shaped element is substantially equal to $\alpha\cdot\lambda/2$, where $\alpha$ denotes a wavelength compaction ratio of the glass, and $\lambda$ denotes a wavelength of transceiving frequency, and a sum of a length of the conductive-film-side line of the first substantially-U-shaped element and a length of a conductive-film-side line of the second substantially-U-shaped element is substantially equal to $\alpha\cdot\lambda/2$.

4. The glass antenna according to claim 2, wherein an auxiliary line is provided to at least one of the substantially-orthogonal line of the first substantially-U-shaped element and a substantially-orthogonal line of the second substantially-U-shaped element.

5. The glass antenna according to claim 1, wherein the first feeding point is further connected with an auxiliary line.

6. The glass antenna according to claim 1, wherein a length of each of the flange-side line and the conductive-film-side line of the first substantially-U-shaped element is substantially equal to $\alpha\cdot\lambda/2$, where $\alpha$ denotes a wavelength compaction ratio of the glass, and $\lambda$ denotes a wavelength of transceiving frequency.

7. The glass antenna according to claim 1, wherein at least one of the flange-side line and the conductive-film-side line of the substantially-U-shaped element is formed with a line-cutout portion.

8. The glass antenna according to claim 1, wherein a width of the film-removed portion is smaller than or equal to 30 mm.

9. The glass antenna according to claim 1, wherein each of shapes of the flange-side line and the conductive-film-side line constituting the substantially-U-shaped element is at least one of a substantially straight-line shape, a substantially L shape, a substantially U shape, a loop shape and a circular-arc shape.

10. The glass antenna according to claim 1, wherein a part of the antenna formed on a surface of the laminated window glass overlaps three-dimensionally with the conductive film formed on the adhesion plane of the laminated window glass, to enable a capacitive coupling therebetween.

11. The glass antenna according to claim 1, wherein the conductive film is formed on a substantially entire range of the surface or the adhesion plane of the window glass.

12. The glass antenna according to claim 1, wherein the window glass or the laminated window glass is a front window glass, a rear window glass, a side window glass or a sunroof glass of the vehicle.

13. A glass antenna system for a vehicle, comprising two or more glass antennas according to claim 1, wherein the two or more glass antennas are provided at two or more spots of at least one of window glasses for the vehicle or laminated window glasses for the vehicle.

* * * * *